United States Patent [19]

von der Eltz et al.

[11] Patent Number: 4,947,660

[45] Date of Patent: Aug. 14, 1990

[54] APPARATUS FOR CONTINUOUS TREATMENT, PREFERABLY DYEING, OF TEXTILE MATERIAL IN ROPE FORM

[75] Inventors: Hans-Ulrich von der Eltz, Frankfurt am Main; Wilhelm Christ, Michelbach/Bilz, both of Fed. Rep. of Germany

[73] Assignee: Hoechst Aktiengesellschaft, Fed. Rep. of Germany

[21] Appl. No.: 416,597

[22] Filed: Oct. 3, 1989

Related U.S. Application Data

[62] Division of Ser. No. 250,924, Sep. 29, 1988, Pat. No. 4,885,814.

[30] Foreign Application Priority Data

Oct. 1, 1987 [DE] Fed. Rep. of Germany ..... 3733219

[51] Int. Cl.[5] ..... D06B 3/28

[52] U.S. Cl. ..... 68/62; 68/177; 68/207

[58] Field of Search ..... 8/149.1, 151.1, 152; 68/5 C, 5 D, 5 E, 176, 177, 178, 62, 207

[56] References Cited

U.S. PATENT DOCUMENTS

| | | | |
|---|---|---|---|
| 3,085,414 | 4/1963 | Wendler | 68/5 D |
| 3,921,420 | 11/1975 | Aurich et al. | 68/5 C |
| 4,006,612 | 2/1977 | Thies | 68/177 |
| 4,041,559 | 8/1977 | von der Eltz | 68/5 E X |
| 4,263,008 | 4/1981 | Sando et al. | 8/149.1 X |

*Primary Examiner*—Philip R. Coe

*Attorney, Agent, or Firm*—Connolly and Hutz

[57] ABSTRACT

In the textile industry there is a constant need for processes where the textile material to be treated can be treated in a simple form, for example in rope form instead of in the open-width state, and continuously. According to the invention, this need is met when the textile material is introduced via pressure seal elements into a specially constructed jet dyeing machine, is impregnated there with treating liquor during entry or immediately thereafter and is conveyed further in the machine by means of at least one jet operated by means of a gas stream, the treating agent applied, preferably dye, having advantageously been subjected to fixation in the course of the presence in the gas atmosphere. The necessary physical conditions (pressure, temperature) for this are created by the driving gas. Moreover, in the course of the passage of the textile material it is possible to carry out a further, including a completely different, impregnation.

15 Claims, 3 Drawing Sheets

Figure 1:
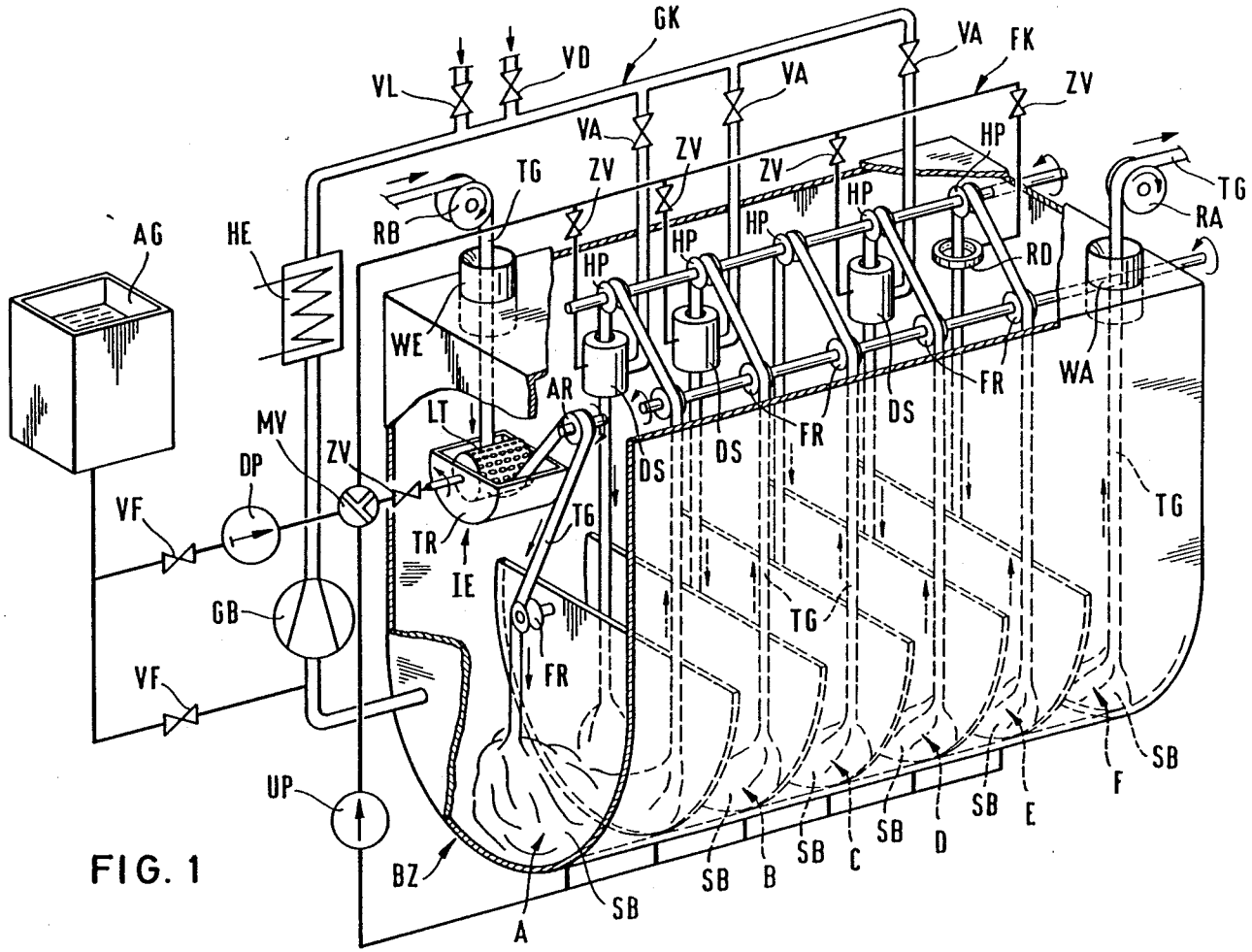

APPARATUS FOR CONTINUOUS TREATMENT, PREFERABLY DYEING, OF TEXTILE MATERIAL IN ROPE FORM

This application is a division of application Ser. No. 250,924, and now U.S. Pat. No. 4,885,814 filed Sept. 29, 1988.

The present invention relates to a process for the continuous treatment, preferably dyeing, of textile material made of synthetic and/or natural fibers in rope form with aqueous liquors—containing treating agents, preferably dyes, suitable for the fiber type in question—or with other textile-finishing products on jet dyeing machines where the propulsive force for the transport of the textile material through the self-contained treatment zone stems essentially from the kinetic energy of a recirculating gas stream generated by actuation of the jet system.

From similar processes mentioned in European Patent Specifications No. EP-B-0,014,919 and No. EP-B-0,078,022 it is certainly already known to subject textile materials in rope form to a wet-processing operation, in particular dyeing, in jet dyeing machines. In this operation, the textile material gathered lotwise or piecewise into rope form and guided past the jets is either set in circulation by means of the treating liquor circulating in the same direction to the jet system or propelled by means of a gas stream or steam/air mixture directed under excess pressure out of the jets at the fiber material.

The principal feature of this operating technique is thus that the textile material is repeatedly transported through the machine in a continuous loop form by the kinetic energy imparted by the tangential impingement of the jet stream, it being possible in this process to alternate or combine the gas and liquid flow to drive the rope during the different treatment stages, which permits a seamless transition from one dyeing step to another without stoppage of the textile material and also under isothermal conditions.

In the batchwise dyeing method described in EP Patent Specification No. 0,078,022, where the rope of textile material is propelled by aerodynamic means, the fiber material is introduced into the dyeing jet in lots and charged therein with the liquor in such a way that the liquor is injected in atomized form into the recirculating gas stream, while the textile material and the treating liquor not absorbed by it are constantly recirculated anew. The application of the total amount of liquor takes place in the course of a plurality of circulations of the textile material, and the continuous recirculation of the excess liquor produces a uniform distribution of the liquor on and within the rope and hence an excellent levelness in the treated article. On completion of the dyeing operation the piece-dyed material is removed from the jet.

The exhaust dyeing of textile material in rope form at a short liquor ratio has also already been described in the earlier American Patent Specification No. U.S. Pat. No. 3,949,575, where, however, the amount of liquor is then reduced to such an extent that no "migrating" liquor, i.e. liquor freely movable outside the textile material and therefore recirculable, remains (non-migrating system). The process described in said US property right differs from the situation in the art as described in EP Patent Specification No. 0,078,022 in particular in that in said US art a clear distinction is still being made between a cold application phase, which serves to distribute the applied liquor, and a warm/hot fixation phase. This two-stage approach no longer exists in the later EP patent specification in question, because there the entire process takes place almost isothermally and the gas stream acting as a transport means is not inert in relation to the intended specific treatment action, so that the same and hence the atomized treating agent, on coming into contact with the unopened textile rope under the preselected temperature and pressure conditions, immediately comes into effect there in the fixing state.

Although, then, it is stated in said EP Patent Specification No. 0,078,022 that this conventional method is also suitable for a continuous operation, no technical teaching whatsoever is disclosed in this respect. All the statements in said literature reference concerning practical handling, on the contrary, are solely concerned with purely batchwise processing.

European Patent Specification No. EP-B-0,132,604, however, has disclosed apparatus and a process for the continuous treatment of textile material in a continuous, non-endless rope form where the textile material is likewise propelled by the jet principle alternately by hydraulic or aerodynamic means. In the course of its passage through the machine the textile material in rope form passes through a number of machine units arranged in series which may serve different purposes, i.e. which may optionally employ different treating agents and treatment conditions, preferably for the wet treatment operation; there are thus separate and different treatment stages provided here which are clearly separated from one another by goods inlet and goods outlet. Although, as is stated, the operating principle evident from the aforementioned EP patent specification can in general be adapted to any desired purpose or scheme as regards the multiple application of liquid treating agents to the rope of textile material, this existing process is exclusively used for washing and cleaning purposes. The key concern here must be to improve the so-called dilution factor between two successive wet treatment stages which may expediently be carried out under the influence of liquor flowing in the opposite direction to the cloth transport direction, for example in the after-treatment of previously dyed fiber material. The intention behind the characteristic dwell period to which the moist textile material arriving from a preceding wet treatment is subjected in the prior art is chiefly to bring about a dewatering in order to increase the effectiveness of the particular treatment operations. The prior art just described therefore neither presents nor suggests a genuine dyeing process including dyestuff fixation on a continuous basis.

The favorable experiences gained from EP Patent Specification No. 0,078,022 concerning the forward propulsion of textiles in rope form in jet apparatus by means of a gas stream and the possible application of treating agents with simultaneous establishment of the requisite physical conditions via the gas responsible for driving the cloth were reasons enough to consider using this aerodynamic system also for fully continuous operation.

The reservations and prejudices against the feasibility of such considerations were in particular that in such a process the dyeing liquor must be applied to the textile material in rope form in a single step similar to padding. And preferably it should be possible to perform almost isothermal dyeing, even, where applicable, under HT conditions.

Under these preconditions the machine to be used can be kept relatively simple, because it need not be especially divided into application zones on the one hand and fixing zones separated from one another, since the reliability and time saving to be achieved with the process can only be guaranteed if the application zone is integrated with or immediately precedes the fixing zone.

The object underlying the invention in question was thus to design the application conditions for the treating agent in such a way that a uniform dyeing is obtained in a fully continuous manner under ideally isothermal conditions with ideally a single application of an ideally minimal amount of liquor.

It is an object of the invention to design a machine suitable for carrying out such a process.

These objects are achieved according to the invention when the textile material, which is in a continuous, non-loop rope form, is continuously run into the treatment zone, if appropriate by way of an element which seals off the outside atmosphere, is impregnated therein in the course of its further passage with the treating, preferably dyeing, liquor and is then conveyed forward through the treatment zone by means of an aerodynamic jet arrangement arranged in the cloth transport direction and comprising at least one transport jet, at such a speed that said rope is exposed to a dwell operation for up to 20 minutes, if desired under fixing conditions for the treating agent, preferably the dye, or mixture thereof, whereupon, finally, the textile rope thus treated is continuously run out again from the treatment zone, if appropriate by way of a further sealing element of the same type as at the start.

The process is in general carried out with the apparatus as follows:

To charge the textile material with the proposed treating agent, the textile material, which is in a continuous rope form not sewn together in a loop, is first subjected to impregnating measures, which can expediently take place immediately during the introduction of the rope into the treatment zone or immediately thereafter, and is then passed to a first jet in which the textile material is brought to the intended treatment temperature by means of hot air or a steam/air mixture. At the same time the propulsive force for the continued transport of the textile rope is provided by the kinetic energy inherent within the blower-generated gas stream. After passing through a (short) dwell loop in the storage zone associated with the jet in order on the one hand that the liquor and heat may be distributed evenly within the rope and on the other that any tension differences within the advancing textile material if there are successive jet systems may be equalized, the impregnated textile material is advantageously passed to a second jet and conveyed by that jet —and similarly via any further necessary jets and further dwell loops—through the treatment chamber. Preferably, according to the invention, the impregnating and the dwelling take place under isothermal conditions.

The application of the treating liquor to the continuously arriving textile material can be accomplished in various ways:

For instance, it is possible to use an impregnating apparatus comprising a relatively small trough inside which at least one perforated drum charged from the inside with liquor rotates. The textile rope is guided between the trough wall and the rotating perforated drum, with partial wrapping, across the shell surface of the drum and is then impregnated in the course of this passage.

The textile material is likewise impregnated if the textile rope passes through one or more annular nozzles arranged (in series) in the rope transport direction and charged with treating liquor. To apply the liquor to the textile material, it has also been found to be advantageous if the treating liquors are added to the circulating gas stream in atomized form by injection within the confines of the jet arrangement for the fabric transport, as already described in EP Patent Specification No. 0,078,022. The same result is further obtained by metering the treating liquor into the gas stream driving the textile rope on the suction side of the blower producing said gas stream, in which case the fine division of the treating liquor in the gas stream is ensured by the atomizing action of the blower.

It is of course also possible to integrate a plurality of impregnating devices within the sealed-off system of the treating zone, so that smaller amounts of similar or, alternatively, different treating liquors can be applied in succession to the textile material, in which case the textile rope is then subjected to repeated impregnating steps having the same or different purposes.

The treating liquors to be applied generally contain all the necessary treating agents, such as, for example, dyes, fixing chemicals, pH-regulants, and other assistants, such as for example - if necessary - carriers or crease inhibitors. They can, if required by stability considerations, also be mixed together only immediately before entry into the dyeing machine by suitable metering means. To ensure thorough saturation of the textile, the liquor may further contain wetting agents and also substances which promote uniform liquor distribution during the subsequent fixing process.

The amount of this liquor which finds use according to the invention is preferably dimensioned in such a way that all of the liquor applied remains within the textile rope and, even in the course of the subsequent fixation, no excess migrating liquor appears, since this liquor, after dripping off the textile rope, would have to be recirculated and recycled into the preceding impregnating step in order to come into effect again and again in the course of the fabric handling sequence.

In the course of development work concerning this invention, it was found that, under the conditions described, perfect levelness is obtained when the goods-to-liquor ratio is between 1:0.6 and 1:2.5. However, at times, depending on the type of textile material to be treated, it may be necessary to use higher liquor-to-goods ratios.

The continued transport of the textile material following impingement with the treating liquor can be effected in various ways:

For instance, the textile rope, after passage through the treatment zone, can be moved forward for example as a coil by means of jets in spiral form in the manner of a rope washer, in which case such jets can be operated with steam, hot air or a steam/air mixture as a matter of choice. The textile material can also be moved on in spiral form purely mechanically via a driven reel or a plurality of separate reels. It is also possible to plait the textile material onto a conveyor belt or a multideck conveyor and expose it in that state to the effect of the fixing atmosphere.

Depending on the fiber material to be treated according to the invention and the treating agents proposed for that purpose, preferably dyes, the treatment temperatures for the aerodynamically active gas stream can vary within certain limits. If the claimed process is carried out under atmospheric pressure, the treatment temperatures are below 100° C., preferably within the range between 10° and 100° C.; if superatmospheric pressure is employed, they are within the range from 100° to 150° C.

A special embodiment of the process in question comes about when it is carried out under the preconditions described in European Patent Specification No. EP-B-0,087,740. According to this continuous dyeing technique, the application of liquor is followed by the use of a defined, psychrometrically controlled steam/air mixture of defined steam content as a fixing medium to create precisely defined conditions within the dwell space, i.e. vapor space (dry-bulb temperature), and—what is even more important —on the impregnated, undried textile material (wet-bulb temperature) which in the course of dye fixation make possible a maximum of color yield under an extremely economical process regime. In this case, the textile material is conditioned as described above, impinged with liquor and then exposed to the steam/air mixture for a maximum of 15 minutes. In certain circumstances, the heating up of the moist material may be augmented for example by irradiation with microwaves.

An apparatus of the type of a jet dyeing machine suitable for implementing the claimed process to which the invention in question likewise relates, which consists essentially of a self-contained, advantageously troughlike receptacle for use as a treatment zone (BZ) for the textile material (TG) passing continuously therethrough in rope form under jet drive, provided with a goods inlet (WE) and a goods outlet (WA) and also, upstream of the former and downstream of the latter, optionally driveable rope rollers (RB; RA) for the purpose respectively of charging the treatment zone (BZ) with or take-up of the textile rope (TG), the treatment zone (BZ) being connected on the outside to separate lines for the supply and the subsequent cycling of gaseous medium (gas cycle GK) for use as the transport means solely responsible for or possibly augmenting the advancement of the textile material (TG), this circulation system (GK) including a blower (GB) for generating and compressing the driving gas stream together with a heat exchanger (HE) on the pressure side of the blower (GB) for controlling the gas temperature, and also of at least one liquor (liquor cycle FK) for use as the liquid treating agent for the impregnating step, this circulation system (FK) incorporating a circulation pump (UP) and connections for one or more liquor feed lines coming from a make-up or stock reservoir (AG) via a metering pump (DP) connected in between, wherein there are present within the treatment zone (BZ)—in the stated order—immediately downstream of the goods inlet (WE) an impregnating means (IE) for applying the treating liquor to the unlooped textile rope (TG), and an aerodynamically active jet arrangement disposed in the cloth transport direction and comprising at least one transport jet (DS) together with the necessary rope guiding rollers (FR) for passing the textile material (TG) through the treatment zone (BZ), each in combination with a storage space (SB) which is constructed as a dwell leg (VS) and through which the impregnated textile rope (TG) passes in the course of the dwell operation with constant forward movement in the tensionless state, for example laid or plaited, it being possible for the storage space (SB) of the treatment zone (BZ) to be subdivided essentially in conformity with the number of transport jets (DS) and/or subsequent dwell legs (VS) if appropriate into at least as many dwell sections (A, B, C, etc.), and also the connections and valves required for operating the machine, specifically for feeding or drawing off the drive gas and the treatment liquor(s) including the lines for their separate recirculation in conjunction with the sections of the associated cycle (GK; FK) which are situated outside the treatment zone (BZ).

Figure 2:
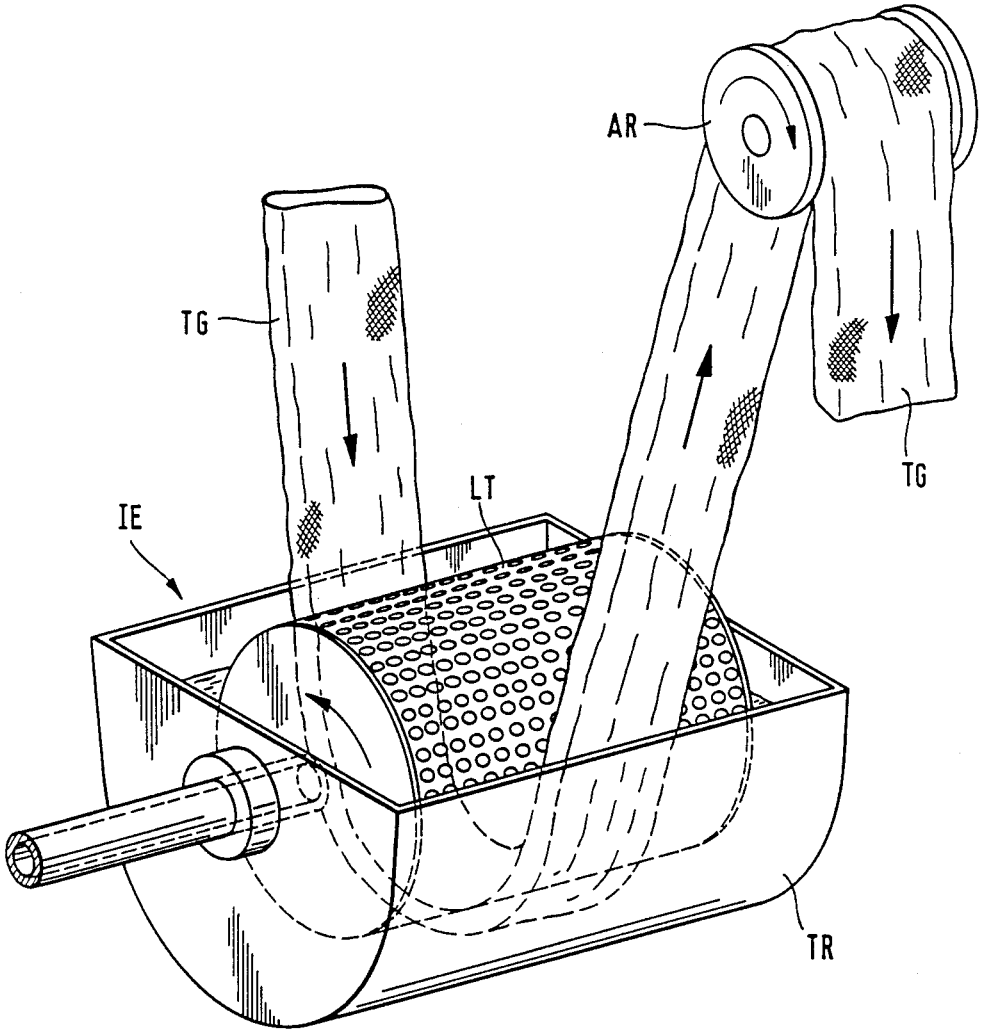
Figure 3:
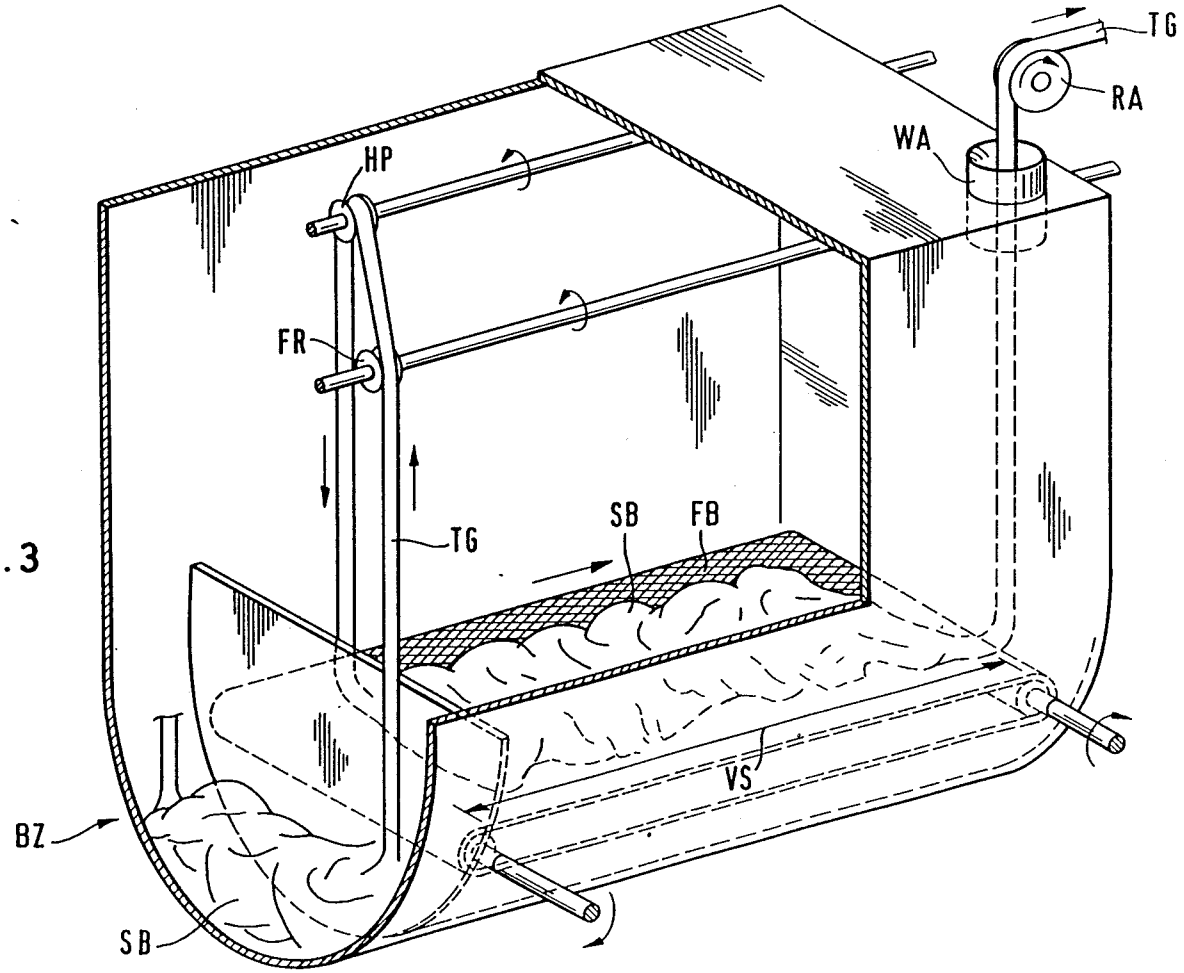

A working example of such apparatus according to the invention is schematically depicted in the accompanying drawings, where FIG. 1 shows an illustration of the jet dye machine as a whole as a perspective in cross-section, FIG. 2 shows in detail an example of an impregnating means (IE) and FIG. 3 shows in detail an example of a conveyor belt (FB) disposed in the storage space (SB)

The reference symbols used in the drawings are identical to the letters used in the text for the same purpose and have the following meaning:

A, B, C . . . =dwell sections
AG=make-up or stock reservoir vessel for treating liquor
AR=take-up roller
BZ=treatment zone
DP=metering pump
DS=transport jet
FB=conveyor belt
FK=liquor cycle
FR=guiding roller
GB=blower
GK=gas cycle
HE=heat exchanger
HP=reel
IE=impregnating means
LT=perforated drum
MV=multiway valve
RA=rope roller at goods outlet/take-up
RB=rope roller at goods inlet/charging
RD=annular nozzles
SB=storage space
TG=textile material in rope form
TR=trough
UP=circulation pump
VA=block-off or throttle valve for gas stream
VD=valve for steam supply
VF=valves for liquor supply
VL=valve for air supply
VS=dwell leg
WA=goods outlet (element)
WE=goods inlet (element)
ZV=metering means for treating liquor.

In conformity with the machine scheme represented as a sketch in FIG. 1, the claimed apparatus is illustrated in a fundamental form which is suitable for performing the abovedescribed process not only under atmospheric pressure conditions but also under HT conditions. Consequently, the lead-in and lead-out elements embodied at the goods inlet (WE) and goods outlet (WA) of the sealed treatment zone (BZ) which in the case of HT processes also serve as pressure seal means are constructed in a particular manner, which is realizable for example with the aid of the seal means known from German Patent Specification No. DE-C-2,537,665 or from German Offenlegungsschrift No. DE-A-2,325,604 for the continuous run-in and run-out of textile material in rope form into and out of pressure-tight vessels.

The impregnating means (IE) can according to the invention be constructed in the manner of FIG. 2 and can represent one or more axially driveable perforated drums (LT), preferably sieve drums, which dip at least partially into a trough (TR), around part of the shell surface of which the textile material is guided in the course of liquor application, and which is or are suppliable from the inside with the treating liquor. Also possible for the same purpose for use as impregnating means (IE) are one or more annular nozzles (RD) arranged in the right order in series in the cloth transport direction, to which the liquor feed lines are connected. As the textile rope passes through these nozzles (RD), the liquid treating agent is then applied to the textile material by squirting or spraying.

In a preferred apparatus embodiment according to the invention for the impregnating step, goods inlet (WE) and impregnating means (IE) form one unit.

FIG. 1 shows the principle of cloth transport in the apparatus in the manner of a rope washer:

The aerodynamically active jet arrangement following the impregnating means (IE) comprises according to the invention a series of transport jets (DS) each provided with an interconnected storage space (SB) and each operable independently of or conjointly with the others by flowing gas.

In the variant shown in FIG. 1, the fabric transport jets (DS) are all equipped for gas drive. This drive receives its kinetic energy from a blower (GB). Depending on the dyes to be used and/or on the textile material to be treated, the said gas can be inert or non-inert with respect to the desired treatment effect; in the latter, the gas is a heated gas, for example steam or hot air or a mixture thereof. Such a mixture is introduced for example into the unit via the valves (VD) and (VL) and recirculated by means of the blower (GB) (gas cycle GK).

Such aerodynamically active transport jets (DS), moreover, can be equipped with one or more mechanical means (ZB) for example injection means, for metering treatment liquor(s) into the gas stream, thereby obtaining a further apparatus modification for impregnating the textile material (TG).

Aside from the above-discussed option of injecting the liquid treating agent into the gas stream within the confines of one or more nozzles (DS), the fluid may also be admixed prior to the blower (GB), which is why in such a case a connection/valve (VF) for metering in the treating liquor is then arranged in the gas cycle (GK) on the suction side of the blower (GB).

It is of course also possible under the present invention to construct the claimed jet dyeing machine on the apparatus side also in such a way that the fabric advance is not exclusively effected aerodynamically with gas but that certain jets are operated hydraulically with flowing liquor, preferably the proposed treating liquor, in which case an impregnation of the passing textile material (TG) is then accomplished at the same time. The apparatus according to the invention then additionally contains for the occurrence of any excess liquor mechanical means for recirculating the same, comprising a discharge line for the liquor at the relevant point of the treating zone (BZ) at the floor of the associated dwell section (A, B, or C, etc.), a circulation pump (UP) and a return line for the excess liquor thus flowing off back to the metering means (ZV) of an aerodynamically active transport jet (DS) or directly to the same or a preceding hydraulically active transport jet.

To augment the aerodynamically and possibly hydraulically active transport jets (DS), finally, other types of dwelling and continued transport are possible. For instance, inside the treatment zone (BZ) there may additionally be one or more driveable reels (HP) arranged in the transport direction for use as further transport elements, or it is also possible, in accordance with the partial view in FIG. 3, to equip a part of the dwell space, i.e. a part of one or more storage spaces (SB) with a driveable conveyor belt (FB) arranged in cloth transport direction, in particular an endless sieve belt onto which the textile rope is conveyed in laid or plaited form.

The working examples which follow are intended to indicate the scope of variation of the process according to the invention without thereby restricting the process in any way. In these examples, unspecified %ages are based on the weight of the particular textile material in the dry state. The dyes are used here in commercial form and consistency.

EXAMPLE 1

A lot of cotton mesh loop material in tube form is to be dyed in a continuous jet. To this end, the individual pieces of fabric are attached to one another at their respective ends in succession by sewing to give a rope in non-loop form, and a forerunner is attached. The latter is then passed through a first jet which serves as a goods inlet and at the same time seals off the actual treatment zone from the outside and conveys the rope aerodynamically by means of saturated steam, into the dyeing machine while being heated in the course of passage through this inlet jet to about 70° C. Moreover the rope takes up around 50% of moisture in the course of the measure mentioned. The moist rope then remains on an average for 1 minute in the associated (first) storage space of the jet machine during which the moisture content and the temperature become completely equilibrated under the conditions employed.

The rope of textile materials thus pretreated is then acted on by a further transport jet, which is operated with a steam/air mixture, and conveyed by this second jet into the dyeing chamber. All the while an aqueous dyeing liquor at about 30° C. is continuously metered into the driving steam/air mixture in such a way that the textile material becomes loaded with an additional 150% of this liquor.

The said liquor contains per liter of water:

0.17 g of the violet reactive dye of the formula

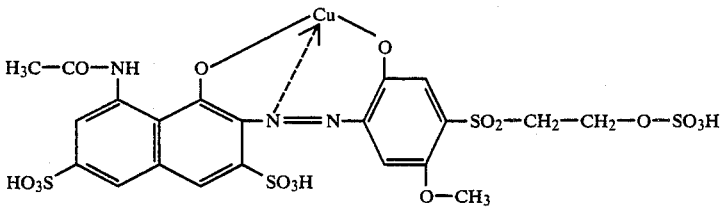

0.17 g of the brown reactive dye of the formula

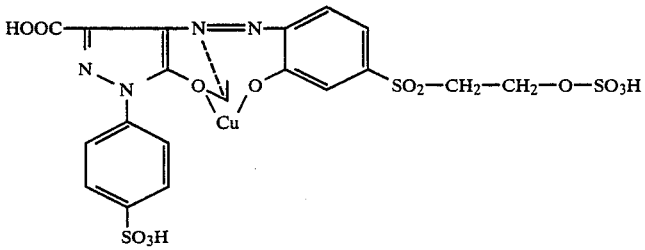

0.25 g of the yellow reactive dye of the formula

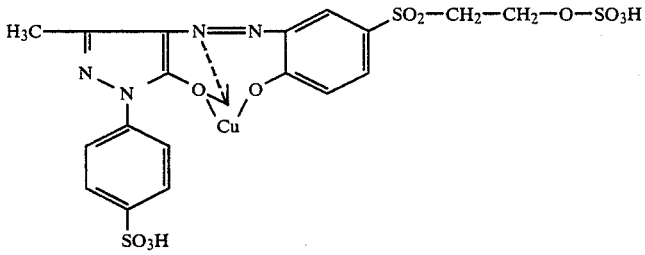

30 g of sodium sulfate and
15 ml of 32.5% strength sodium hydroxide solution.

The sodium hydroxide solution is only mixed into the dyeing liquor immediately before the dyeing liquor is metered into the jet machine.

The steam/air mixture driving the textile rope in the course of this treatment phase is adjusted under psychrometer control in such a way that the fabric has a temperature (wet-bulb temperature) of 70° C. while the steam/air space has a temperature (dry-bulb temperature) of 110° C.

To fix the dye by a hot dwell, the textile material treated in the above-described manner is then left for a further 15 minutes in the fabric store of the jet machine, where it is moved in spiral form via further driven rope rollers in the direction of the goods outlet. Thereafter the textile rope thus dyed is continuously removed from the machine by pulling out and, as is usual for reactive dyes, aftertreated in a separate rope washer.

A sand-colored, level dyeing is obtained on the mesh loop material.

The above dyeing can also be performed with similar success if the fixing agent used for the reactive dyes instead of pure sodium hydroxide solution is a mixture of sodium hydroxide solution and soda waterglass or soda waterglass alone. Also usable here are other proven fixing alkalis.

EXAMPLE 2

To dye woven cotton fabric in a continuous jet, the fabric is introduced into the dyeing machine as in Example 1 in rope form by way of a first jet which is operated with saturated steam, the fabric warming up to about 70°–80° C. and at the same time taking up about 70% of moisture. A short dwell in the storage space of the jet machine makes sure that heat and moisture become uniformly distributed in the entire textile material. The fabric is then transported in spiral form using a plurality of gas-driven transport jets, each passage through every one of those jets being followed by a short interim dwell in the associated storage space (for about 1–3 minutes).

The fabric rope is then charged by means of a second jet with a dyeing liquid by continuously metering the said liquor into the steam/air mixture driving the fabric forward in this jet in such a way that the fabric rope additionally takes up a further 70% of moisture.

This aqueous liquor at 25° C. contains:

105 g/l of the commercially available liquid brand of the dye Leuco Sulfur Brown 96 of C.I. No. 53228,
3 g/l of sodium sulfhydrate (NaHS) and
5 g/l of a 21% strength aqueous sodium polysulfide solution ($Na_2Sx$; x=2–5)

The treatment temperatures in the subsequent dwell store of the machine are set by means of a psychrometer arrangement as follows: wet-bulb temperature 90° C., dry-bulb temperature 120° C.

After passing through a further conveying jet, the material thus treated is removed from the machine as in Example 1 and rinsed with water; the dye picked up is then oxidized in a conventional manner, and thereafter the textile material dyed in this way is again rinsed with warm and hot water until the run-off is clear.

A dark brown, level dyeing is obtained on the cotton fabric.

EXAMPLE 3

A wool fabric in rope form is introduced into a continuous jet dyeing machine and loaded in the first jet of this machine by the action of saturated steam as in Example 1 with about 100% of moisture and heated up to 80° C. After a short dwell time to equilibrate temperature and moisture in the fabric the rope material is treated in a second jet, again to a wet pick-up of 150%, with an aqueous dyeing liquor which contains
12 g/l of the dye Reactive Blue 19 of C.I. No. 61200
and whose pH has been set to 5 by means of acetic acid. By the additional introduction of superheated steam the liquor temperature is raised to 103° C. during the application of the dyeing liquid.

After a further brief dwell of the wool rope a further 10% of an aqueous liquor containing
5 g/l of sodium trichloroacetate
is then metered into the transport gas by a third jet, and the dyeing is continued for a further 20 minutes under the set temperature and moisture conditions during which the wool fabric is further transported over reels in the manner of a rope washer.

The dyed fabric is then removed from the machine and subjected to a conventional aftertreatment in a rope washer.

A level, bright and very fast blue dyeing is obtained on the wool fabric.

EXAMPLE 4

A woven polyester fabric in rope form is introduced into a continuous jet dyeing machine by way of a combination of a seal from the outside atmosphere as described in German Patent Specification No. DE-C-2,537,665 and a first jet operated with saturated steam, in the course of which it heats up to about 100° C. and at the same time picks up a moisture content of about 60%, likewise at 100° C. Temperature and moisture in the fabric are then equilibrated by leaving the textile material in the storage space of the jet machine for a short time (1–2 minutes) under the conditions employed.

In a second jet which conveys the textile material by means of a superheated steam/hot air mixture, a hot aqueous liquor at 90° C. which contains
22 g/l of the dye Disperse Yellow 54 of C.I. No. 47020,
5 g/l of the dye Disperse Red 73 of C.I. No. 11116
and acetic acid for setting a pH of 4.5 is then metered into the circulating drive gas in such a way that in the course of the measures mentioned the polyester fabric picks up about a further 100% of liquor. The temperature of liquor and textile material is raised to about 130° C. by the driving superheated steam/hot air mixture. Via further transport jets the fabric is then transported aerodynamically along a spiral with a dwell time of 1–2 minutes for the loops formed in the storage space of the machine to each of the jets. All the while the temperature in the machine is maintained at a constant 130° C. By additional injection of HT steam at the same time the liquor is prevented from evaporating off the textile material.

After 6 circulations including dwells in the storage space under the aforementioned conditions the textile material is fed through a pressure seal as described in German Patent Specification No. DE-C-2,537,665 to a separate cooling compartment and is removed therefrom for an aftertreatment carried out in a conventional manner.

The result obtained thereafter on the polyester fabric is a level yellowish orange dyeing.

EXAMPLE 5

The dyeing of Example 4 in a continuous jet can also be carried out as follows:

Introducing, conditioning (initial moisture) and charging the polyester fabric with the dyeing liquor take place in exactly the same way as in Example 4. Except that the driving steam/air mixture, owing to reduced heat capacity, only brings about a temperature of 100° C. in the machine and on the textile material.

In this state the textile material is run for about 10 minutes via reels or jets through the machine in a spiral pattern. Thereafter a further 10% of an aqueous liquor containing
10 g/l of a commercially available carrier based on methyl salicylate (as emulsion)
are applied to the colorant-saturated material via a jet suitable for product addition to the drive gas, and the textile material is exposed in the same way as above to the action of the gaseous fixing medium for a further 10 minutes.

The dyed material can then be removed from the machine and aftertreated in a conventional manner.

The dyeing result corresponds to that of Example 4.

EXAMPLE 6

A knitted textured polyester fiber fabric in a continuous non-loop rope form is introduced via a pressure seal as in Example 4 into the dyeing machine and immediately after entry into the continuous jet charged with the aid of a sieve drum means as shown in FIG. 2 with an aqueous liquor at 90° C. containing per liter
11 g of the dye Disperse Yellow 54 of C.I. No. 47020
5 g of the dye Disperse Red 73 of C.I. No. 11116
3 g of the dye Disperse Blue 56 of C.I. No. 63285
and also acetic acid for setting a pH of 4.5.

The knitted fabric then has a moisture level of 300% and passes as a result of the mechanical tension exerted by the rotating sieve drum into the first dwell compartment. Excess liquor, which drips off the textile material, is sucked away at the floor of this compartment and fed via a pump and an injection jet into the gas stream of a first transport jet charged with steam at 130° C. This first downstream jet removes the rope from the first dwell compartment and conveys it into the second compartment. Owing to the steam flow employed, a temperature of 130° C. prevails in the entire machine designed as a pressure chamber. A further steam-operated jet and subsequent driven rope rollers ensure the continuous transport of the PES fabric through the machine, a dwell period for the textile material of about 3 minutes being inserted between each pair of adjacent steam jets. After a total of 20 minutes the fabric rope is removed again from the dyeing jet via a pressure seal of the same type attached to the other end and is finally aftertreated in a conventional manner.

A brown dyeing is obtained on the fabric.

We claim:

1. Apparatus for continuously treating textile material made of synthetic and/or natural fibers in continuous rope form with aqueous treatment liquor, the apparatus comprising a jet dyeing machine having a self-contained treatment zone and a recirculating gas stream generated by actuation of a jet system, the kinetic energy of which provides a propulsive force for continuously transporting the textile material through the self-contained treatment zone, a textile material inlet for introducing the textile material into the self-contained treatment zone, a textile material outlet for removing textile material from the treatment zone, a line connecting the recirculating gas stream to the treatment zone, a blower in the line for generating and compressing the gas stream, a heat exchanger in the line for controlling the temperature of the gas stream, liquor recycle means for recycling treatment liquor drawn from the treatment zone back into the treatment zone including a circulating pump and a make-up reservoir connected to introduce additional treatment liquor into the recycle, and the treatment zone including impregnating means for applying treatment liquor to the textile material and an aerodynamically active jet arrangement having at least one transport jet for moving the textile material through the treatment zone, and a plurality of storage spaces in the treatment zone in which the textile material dwells and through which the textile material passes as it travels through the treatment zone in a generally tensionless state.

2. Apparatus as in claim 1 wherein the textile material inlet and textile material outlet are constructed as elements which seal off outside atmosphere.

3. Apparatus as in claim 1 wherein the textile material inlet and impregnating means form one unit.

4. Apparatus as in claim 1 wherein the impregnating means comprises at least one axially driveable perforated drum over which the textile material is trained which dips at least partially into a trough charged with the treatment liquor while the perforated drum and the textile material are passed through by the recycled treatment liquor.

5. Apparatus as in claim 1 wherein the impregnating means comprises at least one annular nozzle arranged to apply treatment liquor to the textile material.

6. Apparatus as in claim 1 wherein the aerodynamically active jet arrangement downstream of the impregnating means comprises a series of transport jets each with an interconnected storage space.

7. Apparatus as in claim 6 wherein the transport jets are operable independently of one another.

8. Apparatus as in claim 6 wherein the transport jets are operable conjointly with the gas stream.

9. Apparatus as in claim 6 wherein at least one of the aerodynamically active transport jets is associated with at least one mechanical means for metering treatment liquor into the gas stream.

10. Apparatus as in claim 6 wherein in addition to the aerodynamically active jet arrangement there is at least one hydraulically active transport jet.

11. Apparatus as claim in claim 10 wherein at least one hydraulically active transport jet is operable by means of treatment liquor.

12. Apparatus as in claim 10 including mechanical means for recirculating any excess treatment liquor.

13. Apparatus as in claim 1 including at least one driveable reel over which the textile material is trained to assist in transporting the textile material through the treatment zone.

14. Apparatus as in claim 1 wherein at least one of the storage spaces includes a driveable conveyor belt arranged to transport textile material through that storage space of the treatment zone.

15. Apparatus as in claim 1 including a connection valve for metering treatment liquor into the gas stream on a suction side of the blower.

* * * * *